US012234620B2

(12) United States Patent
Timmerman

(10) Patent No.: US 12,234,620 B2
(45) Date of Patent: Feb. 25, 2025

(54) TIEBACK INSTALLATION APPARATUS AND SYSTEM

(71) Applicant: James Timmerman, Marco Island, FL (US)

(72) Inventor: James Timmerman, Marco Island, FL (US)

( * ) Notice: Subject to any disclaimer, the term of this patent is extended or adjusted under 35 U.S.C. 154(b) by 0 days.

(21) Appl. No.: 17/538,523

(22) Filed: Nov. 30, 2021

(65) Prior Publication Data

US 2022/0170230 A1 Jun. 2, 2022

Related U.S. Application Data

(60) Provisional application No. 63/119,634, filed on Nov. 30, 2020.

(51) Int. Cl.
*E02D 5/76* (2006.01)
*E02D 5/80* (2006.01)
*E02D 29/02* (2006.01)

(52) U.S. Cl.
CPC ..... *E02D 29/0233* (2013.01); *E02D 5/801* (2013.01); *E02D 2600/30* (2013.01)

(58) Field of Classification Search
CPC . E02D 29/0233; E02D 5/801; E02D 2600/30; E02D 29/0241
See application file for complete search history.

(56) References Cited

U.S. PATENT DOCUMENTS 4,711,604 A * 12/1987 Heimsoth ..... E02D 5/76 405/262
5,791,820 A * 8/1998 Rempel ..... E02D 7/20 405/303
2005/0008439 A1* 1/2005 Timmerman ..... E02D 5/765 405/262
2005/0074299 A1* 4/2005 Nolan ..... E02D 5/801 175/323
2008/0085161 A1* 4/2008 Oberg ..... E21D 20/00 405/259.1
2010/0307827 A1* 12/2010 Piipponen ..... E21B 19/14 405/259.1
2014/0259991 A1* 9/2014 Atchley ..... E02D 5/801 52/157
2015/0117961 A1* 4/2015 Olsson ..... E21D 21/00 405/259.1

* cited by examiner

*Primary Examiner* — Carib A Oquendo
(74) *Attorney, Agent, or Firm* — Andrew Morabito

(57) ABSTRACT

The present invention is a tieback installation system, comprising: a mount, wherein the mount is secured to a piece of machinery having mechanical, hydraulic, and electrical connection means; a motor mechanically connected to the mount and hydraulically and electrically connected to the piece of machinery; and a drive shaft connected to the motor, wherein the drive shaft is sized to receive an anchoring member.

19 Claims, 3 Drawing Sheets

TIEBACK INSTALLATION APPARATUS AND SYSTEM

BACKGROUND OF THE INVENTION

The present invention relates generally to the maintenance of retaining walls (seawall, bulkhead, and the like) and, more particularly, to an apparatus and for maintaining retaining walls using and installation apparatus and anchoring devices to strengthen the retaining wall to resist potential damage and/or repair actual damage in the wall.

Seawalls are commonly installed between bodies of water and earth to provide physical boundaries between the bodies of water and the earth and to support or retain the earth by resisting the pressure of the retained earth against the seawalls. Seawalls can be used to separate earth from various types of bodies of water of various sizes and depths. Seawalls can be constructed in various ways and of various materials. Typically, seawalls have a vertical span or height sufficient for an upper end of the seawall to normally extend above the water with a lower end or toe portion of the seawall embedded in the earthen floor to extend below the body of water. The distance that a seawall extends above the water may vary depending on the height of the retained earth above the water and/or anticipated fluctuations in water level. The depth to which the embedded toe portion extends below the water into the earthen floor may vary in accordance with the vertical span of the seawall, the height of the retained earth and/or the depth of the body of water to provide sufficient support for the seawall to resist movement from the pressure of the retained earth against the seawall. Accordingly, seawalls are usually designed for a particular depth body of water. The thickness of seawalls may vary depending on site-specific loads and other engineering parameters. One representative type of seawall comprises concrete panels about ten to fifteen feet high, about four feet wide and about four to ten inches thick disposed in side-by-side abutment to form a continuous wall. Oftentimes vertical pilings are installed in the water close to the water facing side of a seawall at spaced locations along the seawall, with lower ends of the pilings being driven into the earthen floor and upper ends of the pilings typically extending above the water. The pilings are sometimes installed as part of the original seawall installation.

Since the retained earth exerts greater pressure against seawalls than the pressure exerted against the seawalls by the water, seawalls are oftentimes damaged or destabilized during their lifetimes as evidenced, for example, by movement, displacement, shifting, cracking and/or misalignment of the seawalls. Sometimes seawalls are placed at risk for damage or instability due to a change in conditions occurring subsequent to installation of the seawalls. For instance, a body of water may be dredged and/or erosion of the earthen floor may occur subsequent to installation of a seawall, resulting in a greater depth body of water and a lesser depth of penetration for the toe portion of the seawall into the earthen floor. The lesser depth of penetration for the toe portion into the earthen floor may no longer be sufficient for the seawall to support the pressure of the retained earth such that the seawall is susceptible to damage or instability. In some cases, the height of the retained earth on the earth facing side of an existing seawall may be increased, causing increased pressure of retained earth against the seawall by which the seawall may be damaged or destabilized. A type of damage known as "toe out" may occur in seawalls where the toe portion shifts or displaces outwardly in a direction away from the retained earth due to the toe portion being insufficiently embedded in the earthen floor. In addition to the pressures of retained earth, seawalls may be damaged or destabilized directly or indirectly due to other conditions including collisions or other impacts, corrosion, environmental factors, and age. Since removal and replacement of damaged and/or unstable seawalls involves significant cost and disruption, it is preferable to strengthen existing seawalls to repair and/or avoid damage or instability.

One traditional method for arresting movement of seawalls involves installing vertical pilings in the water close to the water facing side of a seawall by driving lower ends of the pilings into the earthen floor. Depending on how close the pilings are to the seawall, cement bags may be packed between the pilings and the seawall to resist seawall movement. Sometimes vertical pilings are installed to shore up an undamaged portion of a seawall while repairs are made to another portion of the seawall that is in total failure. Another traditional method for arresting movement of seawalls entails the placement of riprap on the earthen floor adjacent the water facing side of a seawall. The latter methods are costly, obtrusive, and can initiate damage in other portions of the seawall. Where vertical pilings are used to shore up a portion of a seawall, installation of the pilings can cause portions of the seawall farther down to fail in a "domino" effect.

The prior apparatus and methods for repairing and/or strengthening seawalls and other retaining walls have various disadvantages including complicated structure and installation steps, major disruption, the need for excavating and/or disturbing the earth, the need to bring heavy machinery onto property on the earth facing side of the seawall, lengthy regulatory permitting requirements, partial or complete demolition of existing walls, the need to temporarily hold back or contain water during installation, the need to install additional and/or replacement wall structure, substantial duration of time from start to completion of work, the use of cementitious material to assist in anchoring, the need for backfill, and the inability to execute seawall stabilization from the water side of the seawall. Prior apparatus and methods which require substantial earth-side access or earth-side excavation are untenable where homes, other structures such as docks and pools, and/or landscaping are situated close to seawalls, making it undesirable and even prohibitive to disturb the earth or bring heavy equipment onto the land on the earth facing side of the seawall and/or to conduct seawall maintenance from the earth facing side. Prior attempts at stabilizing seawalls have failed to provide an integrated system of components to accomplish stabilization of various types of seawalls quickly, efficiently and economically from the water side of the seawall. Prior apparatus for repairing and/or strengthening seawalls and other retaining walls are essentially static and non-adjustable, and the use of cementitious material generally prevents adjustability in response to dynamic changes in the walls. Prior apparatus for repairing and/or strengthening seawalls and other retaining walls are essentially permanent and non-removable, especially where cementitious material is utilized. Prior apparatus for repairing seawalls and other retaining walls are in general unsuitable for monitoring changes occurring in the walls over time. Many prior apparatus and methods for repairing seawalls are environmentally incompatible and result in significant obstruction of or intrusion into the body of water on the water facing side of the seawall. Prior apparatus and methods for repairing and/or strengthening seawalls and other retaining walls using anchors or tie rods generally lack the ability to rigidly interconnect a plurality of spaced anchors or tie rods installed in a wall to maintain the spacing between the anchors or tie rods in a desired direction.

The present invention provides for a solution to the problems and disadvantages of the prior apparatuses and methods. Through a novel helical tieback installation apparatus and method that is sustainable, reliable, and effective regardless of the bulkhead or retaining wall.

SUMMARY

In a first embodiment, the present invention is a tieback installation system, comprising: a mount, wherein the mount is secured to a piece of machinery having mechanical, hydraulic, and electrical connection means; a motor mechanically connected to the mount and hydraulically and electrically connected to the piece of machinery; and a drive shaft connected to the motor, wherein the drive shaft is sized to receive an anchoring member.

In a second embodiment the present invention is a tieback installation system comprising: a guide system connected to a piece of machinery; a motor mechanically connected to the guide system and hydraulically and electrically connected to a control unit; a drive shaft connected to the guide system, wherein the drive shaft is sized to receive an anchoring member.

In a third embodiment, the present invention is a tieback installation system comprising: a guide system connected to a piece of machinery, wherein the guide system comprises; a mount, wherein the mount is attached to the piece of machinery; a beam attached to the mount, and a carriage connected to the beam, a motor mechanically connected to the carriage and hydraulically and electrically connected to a control unit; a drive shaft connected to the motor, wherein the drive shaft is sized to receive an anchoring member.

DETAILED DESCRIPTION OF THE INVENTION

Figure 1:
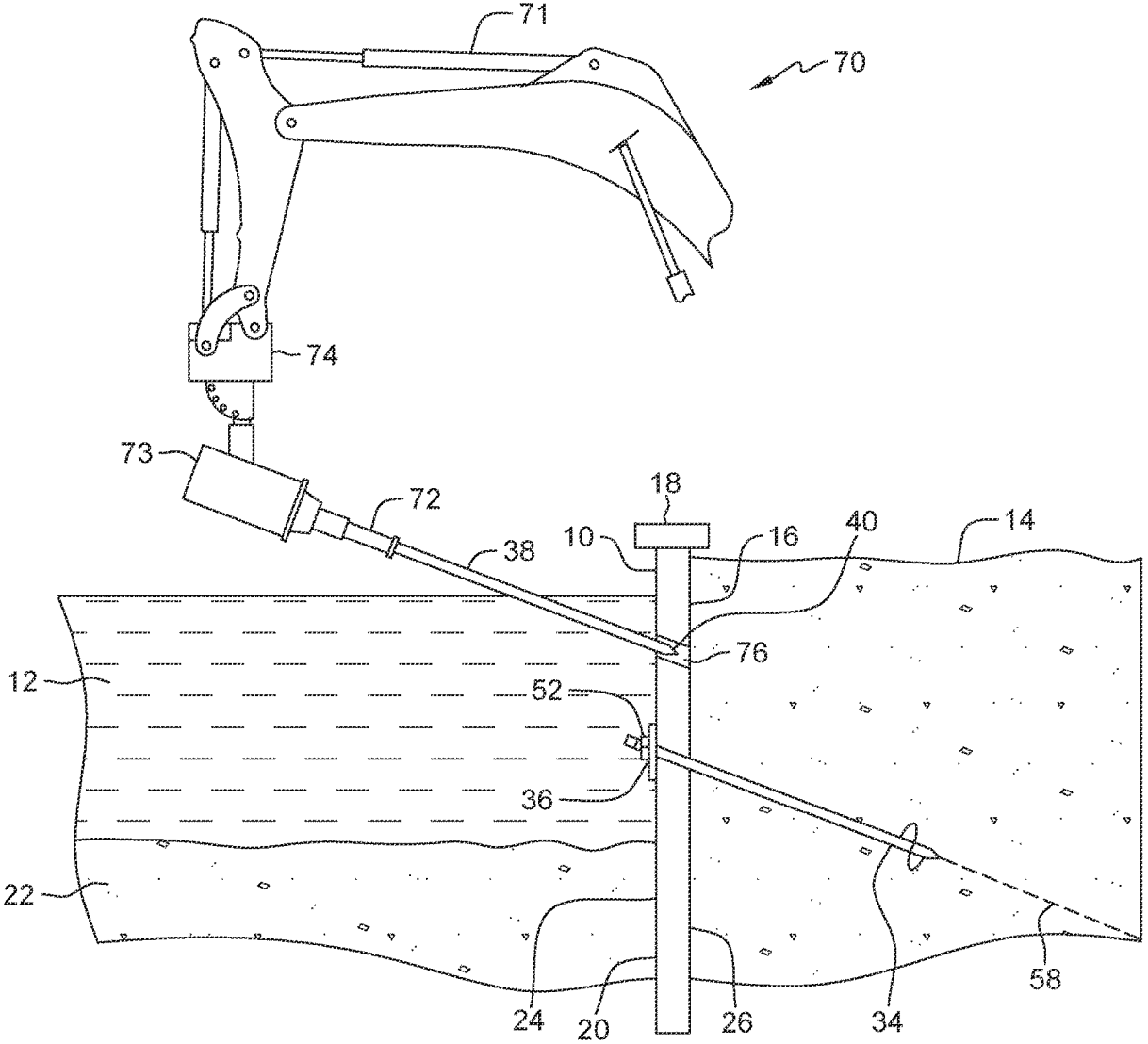
FIG. 1 depicts an illustration of a tieback installation device and method, in accordance with one embodiment of the present invention.

The present invention provides a tieback installation system and method that allows for the installation of helical tiebacks in seawalls, bulkheads, and retaining walls. The system is versatile in that it can be used for a variety of different environments, situations, and is compatible with various types of heavy construction equipment (e.g., cranes, excavators, ski steers, etc.) as well as a stand along system.

Accordingly, it is an object of the present invention to overcome the aforementioned disadvantages of prior apparatus and methods for maintaining seawalls. The system provides for an increased tieback installation efficiency, and greater mobility for tieback installation. With the ability to improve the accuracy of the tieback installation, and created a more dependable installation process, the present invention is an improvement over the prior art and the methods which are currently used to install tiebacks.

Another object of the present invention is to strengthen a seawall utilizing one or more anchoring devices each including an anchoring member having a shaft installed to extend through the seawall from a water facing side thereof and an anchor anchored in earth on an earth facing side of the seawall, and a retaining member secured on the shaft along the water facing side of the seawall. The present invention allows for an excavator or another piece of heavy machinery to have a mounted motor to drive the anchor into the earth and alleviate the need to have a structure or device built or installed in the water. Another object of the present invention is to compress a seawall with a desired compressive force between anchoring members extending through the seawall at laterally spaced locations.

The aforesaid objects are achieved individually and in combination, and it is not intended that the present invention be construed as requiring two or more of the objects to be combined unless expressly required by the claims attached hereto.

Some of the advantages of the present invention are that the anchoring devices are installed from the water facing sides of seawalls without the need for excavating or disturbing the earth, removing existing seawalls or seawall portions, adding additional seawalls or seawall portions, water containment, and backfill; the anchoring devices are installed using procedures conducted from the earth side with an excavator or another piece of heavy machinery with a motor mounted on the piece of machinery and drives the anchor through the water facing side of the seawall into the earth without disrupting the earth. The anchors can have various configurations including helical formations, arm formations and/or expandable/collapsible formations; any type of earth anchor can be used on the anchoring members; the apparatus and methods of the present invention can be employed on various types of seawalls made of various materials and having various dimensions; the apparatus and methods of the present invention may be used for various aspects of seawall maintenance including the repair of damaged seawalls and as a preventative to avoid damage to existing seawalls not already damaged; the apparatus and methods of the present invention may be used to repair or avoid various types of actual or potential damage to seawalls including movement, shifting or displacement of seawalls, cracked or separated seawalls and misalignment of seawall panels; the apparatus and methods of the present invention may be used for various stages of disrepair in seawalls; depending on the extent of deviation from original specifications, a seawall may be restored to original specifications with a single adjustment performed upon installation of one or more anchoring devices or with multiple incremental adjustments performed dynamically over time following installation of one or more anchoring devices; the apparatus and methods of the present invention may be implemented in accordance with site-specific conditions and engineering requirements; the apparatus and methods of the present invention are particularly advantageous for use where earth-side access is restricted or not viable and/or where replacement of a seawall would entail negative consequences; installation of the anchoring devices may be accomplished using conventional machinery and tools; the number of and locations for the anchoring members installed in a seawall may vary in accordance with individual requirements; the anchoring members may be interlocked in various lateral directions including vertical, horizontal and/or any other angular lateral direction on the seawalls; pairs of anchoring members may be forcefully drawn toward one another in various lateral directions including vertical, horizontal and/ or any other angular lateral direction on the seawalls; the shafts of the anchoring members extend through passages formed through the seawalls to facilitate installation; where the cross-sectional sizes of the passages are larger than the cross-sectional sizes of the shafts therethrough, the excess cross-sectional area of the passages not occupied by the shafts may be filled in various ways; ferrules or other structural members may be disposed on the shafts and introduced in the passages with an interference fit to fill the excess cross-sectional area not occupied by the shafts, to support the shafts in the passages and/or to center the shafts in the passages; the retaining members can be designed in various ways for securement on the shafts parallel or non-parallel to the water facing sides of the seawalls; various types of securing members may be used to secure the retaining members on the shafts of the anchoring members; the retaining members may have abutment surfaces configured to abut the water facing sides of the seawalls; various inserts can be inserted or interposed between the retaining members and the water facing sides of the seawalls; the retaining members distribute forces or pressures on the seawalls; the anchoring members can be interlocked by interlocking the retaining members therefor; the retaining members of any two anchoring members can be rigidly interlocked using a fixed length connecting member having opposing ends secured to the retaining members of the two anchoring members, respectively; the retaining members of any two anchoring members can be adjustably interlocked using an adjustable length connecting member having opposing ends secured to the retaining members of the two anchoring members, respectively; the apparatus and methods of the present invention can be used to strengthen existing seawalls for which the depth of penetration of the toe portions is reduced, such as following deepening of the bodies of water on the water facing sides of the seawalls; and the apparatus and methods of the present invention can be used to strengthen existing seawalls for which the height of retained earth is increased on the earth facing sides of the seawalls.

FIG. 1 illustrates a seawall 10 installed in use between a body of water 12 and retained earth 14. Seawall 10 comprises a plurality of seawall panels 16 in side-by-side abutment. Panels 16 are depicted as being planar with each panel having a height or span in the vertical direction, a width in the horizontal direction and a thickness perpendicular to the height and width. The seawall 10 has an upper end, which may be finished with a cap 18, normally extending above the water 12, a lower end or toe portion 20 penetrating the earthen floor 22 to extend below the water 12, a water facing side 24 and an earth facing side 26. The distance that the upper portion extends above water 12 will usually depend on the height of retained earth 14 above water 12 and/or anticipated fluctuations in the level of water 12, for example due to tides and/or storms. The toe portion 20 is typically driven into the earthen floor 22 during installation of seawall 10, and the distance the toe portion extends below the water 12 is typically selected in accordance with the depth of body of water 12, the height of retained earth 14 and/or other site-specific conditions to support the seawall in an upright vertical orientation to resist the pressure of retained earth 14.

In one representative seawall, the panels 16 are made of concrete and have a height of about ten to fifteen feet, a width of about four feet and a thickness of about three to five inches. The seawall 10 can be constructed in various alternative ways including, for example, as bulkheads, pilings and/or piers, and of various materials including, for example, steel, wood and concrete. The seawall 10 can have various dimensions. Body of water 12 may be any type of body of water including, for example, oceans, harbors, channels, sounds, rivers and lakes. The retained earth 14 may comprise one or more constituents including, for example, dirt, sand, rock and shells. One representative composition for retained earth 14 is an aggregate of sand and shell. Site-specific conditions may be determined using standard engineering tests and/or calculations, such as soil analysis, from which the force or pressure on seawall 10 from earth 14 can be determined.

The force or pressure exerted on seawall 10 by retained earth 14 is ordinarily greater than the force exerted on seawall 10 by body of water 12 such that the seawall may become damaged or unstable. Damage or instability of seawall 10 may be evidenced by movement, displacement or shifting of seawall 10 from its upright vertical orientation, by openings in the seawall due to cracks in individual seawall panels 16 or separation of adjacent seawall panels 16, and/or by misalignment of seawall panels or cracked portions of panels. Various other conditions may contribute to or cause damage or instability in seawall 10 including collisions or other impacts with the seawall, corrosion and age. Consequently, the seawall 10 may no longer be able to support or retain the retained earth 14 and may be increasingly susceptible to damage or instability. In accordance with the present invention, seawall 10 is maintained by installing one or more anchoring devices to strengthen and repair the seawall where there is actual damage or instability in the seawall and/or to strengthen the seawall to resist potential damage or instability in the seawall from the pressure of earth 14 or other causes. Accordingly, maintenance of a seawall in accordance with the present invention is intended to encompass repair and/or strengthening of a seawall in cases of actual or potential damage or instability arising from the pressure of retained earth and/or other causes.

An anchoring member 34 according to the present invention is illustrated in FIG. 1 and comprises an anchoring member 34 and a retaining member 36. Anchoring member 34 includes an elongate shaft 38 having a forward end 40, a rearward end and at least one anchor 34 carried on shaft 38. The shaft 38 is longitudinally straight and has a central longitudinal axis. The shaft may have various uniform or non-uniform cross-sections to extend through a passage formed in seawall 10 as explained further below. Shaft 38 is depicted with a circular cross-section that is uniform or constant along the length of the shaft; however, the cross-section of the shaft can be non-uniform or non-constant along its length. The anchor 34 may be carried on shaft 38 close to or along forward end 40 but may be disposed at various locations along the length of the shaft. The anchor 34 can have various configurations to anchor the anchoring member 34 in earth 14 and resist withdrawal of the anchoring member from the earth, and any type of earth anchor can be used for anchor 34. The anchor 34 is depicted as comprising a helical formation of sufficient external diameter to anchor the anchoring member 34 in earth 14 and resist withdrawal of the anchoring member from the earth. In one embodiment, the helical formation facilitates advancement of the anchoring member 34 in earth 14 via rotation and forward longitudinal movement of the anchoring member. The forward end 40 may terminate at a taper, point or other configuration to facilitate advancement of the anchoring member 34 in earth 14 as described further below. The rearward end may be provided with engagement structure for engagement with securing structure of the anchoring device as described further below. The engagement structure may be designed in various ways, and the engagement structure is depicted by way of example as a thread along the rearward end of the shaft 38. The anchoring member 34 may be made of various materials enabling the anchoring member 34 to sustain preselected torque, compression and tensile forces. Representative materials include galvanized steel and stainless steel.

The retaining member 36 may be designed in various ways to be secured on the rearward end of shaft 38 via securing structure formed separately from or as part of the retaining member. The retaining member 36 includes a flange 52 having a forward abutment surface and a passage 76 extending through the flange at an angle to the abutment surface. The flange 52 is depicted as being planar with planar abutment surface for abutment with the planar water facing side 24 of seawall 10. It should be appreciated, however, that the abutment surface and/or the flange can have various non-planar configurations and can have various perimetrical configurations including a square perimetrical configuration. The passage 76 may be centrally or non-centrally located in flange 52 and has a central longitudinal axis 58 disposed at an angle As an example of securing structure formed as part of the retaining member, the retaining member 36 can include retaining member 36 engageable with the engagement structure of shaft 38 to secure the retaining member 36 on the shaft 38 in a desired longitudinal position along the length of the shaft 38. The securing structure formed as part of the retaining member 36 can be designed in various ways and may comprise an internal thread along passage 76 threadedly engageable with the external thread 50 of shaft 38. As an example of securing structure formed separately from the retaining member 36, the anchoring member 34 may comprise a retaining member 36, such as a nut, having an internal thread along a hole therethrough for threadedly engaging the external thread 50 of shaft 38 and having an external size preventing passage of the securing member through the passage 76 of the retaining member. For ease of installation and adjustment, the retaining member 36 may be preferable to the retaining member 36, in which case the retaining member 36 can be provided without retaining member 36. When retaining member 36 is disposed on shaft 38 with the shaft 38 extending through passage 76, the central longitudinal axis 58 of passage 76 and shaft 38 is disposed at angle A with the plane P of abutment surface as shown in FIG. 1. As explained further below, angle A is an acute angle which corresponds to an acute angle selected for the central longitudinal axis of shaft 38 with the water facing side 24 of seawall 10 when the shaft 38 extends angularly downwardly through the thickness of the seawall 10 from the water facing side 24 to the earth facing side 26.

A method for maintaining seawall 10 using anchoring member 34 is performed from body of water 12 without the need for excavating or disturbing retained earth 14 or earthen floor 22 and without the need for earth-side access to seawall 10.

As shown in FIG. 1, the method can be conducted from a piece of heavy machinery 70 located on the earth 14, which may be an excavator or other piece of heavy machinery which has an arm 71 which is able to reach out over the seal wall 10. A mount 74 is used to attach a motor assembly 73 to the arm 71 of the machinery 70. Given the variability of this type of machinery 70, the mount 74 may take on a variety of embodiments, provided it is able to mechanically attach the motor assembly 73 to the arm 71. The mount 74 may permit the electrical and hydraulic connect between the machinery 70 and the motor assembly 73. Given the many different types of heavy machinery 70 and their arm 71 member, the mount 74 is specific to that piece of machinery 70 and that arm 71 and may have a variety of designs.

Attached to the mount 74 is the motor assembly 73. The motor assembly 73 is either electrically or hydraulically attached to the machinery 70 to allow for the control of the motor assembly 73 to be remote. This may be through wired or wireless controls. The motor assembly 73 provides for rotational movement, and also may provide for longitudinal movement along a central axis of the motor assembly 73. The motor assembly 73 has a drive shaft 72. In one embodiment, the anchoring member 34 is attached to the drive shaft 72 and driven into the earth 14 they the movement of the motor assembly 73. In this embodiment, the arm 71 of the machinery 70 is moved longitudinally along a central axis of the motor assembly 73.

Figure 2:
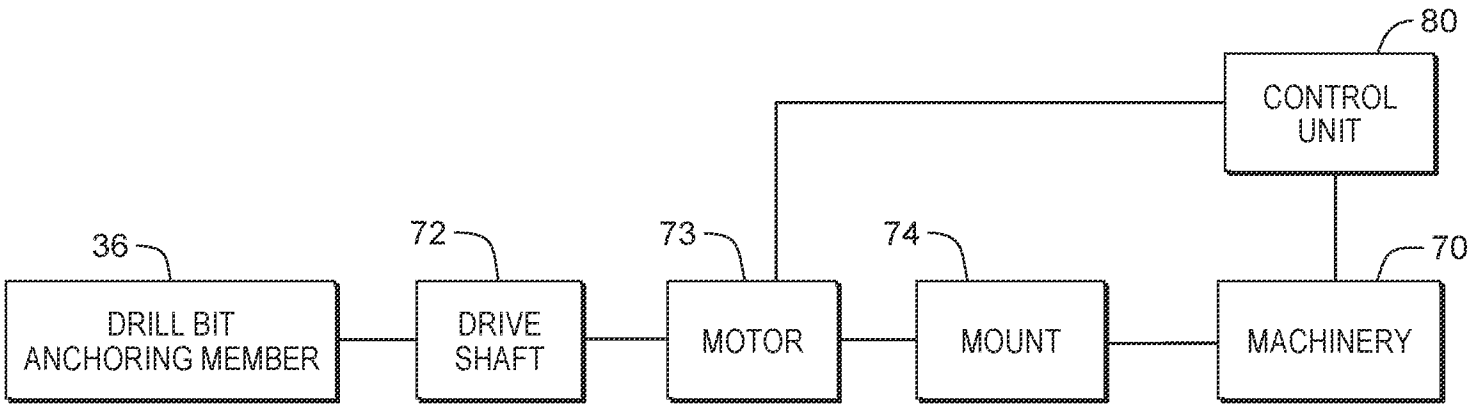
FIG. 2 depicts a block diagram of a tieback installation device, in accordance with one embodiment of the present invention.

As shown in the block diagram of FIG. 2, the motor assembly 73 is hydraulically and electrically connected a control unit 80 of the piece of machinery 70. The motor 73 provides for the directional drilling or boring. The drive shaft 72 that is rotatable as well as being freely movable forwardly and rearwardly as well as in other directions based on the abilities of the machinery 70. The drive shaft 72 is capable of being positioned at various angles to the seawall 10. A drill bit is carried by the drive shaft 72 and may be removably coupled or connected to the forward end of drive shaft 72 in any suitable manner. Various couplings or connectors may be provided for removably coupling or connecting the drive shaft 72 to the anchoring member 34 in coaxial relation or alignment, and the drive shaft 72 may also be removably couplable or connectable with the retaining member 36 using suitable couplings or connectors. Additional machinery and/or tools may be carried by machinery 70 as needed to conduct seawall maintenance pursuant to the present invention. The machinery 70 also includes suitable instruments or gauges for measuring tension, compression and torque. In additional embodiments, guides may be attached to the motor 73 or the mount 74 to provide assistance with positioning of the device in low visibility conditions, or to assist the operator with positioning the arm 71 in the correct position. In further embodiments, the motor 73 and the drive shaft 72 may be able to be independently moved, so that once the arm 71 is in position, the motor and the drive shaft 72 are able to longitudinally move the anchoring member 34 or the bore. This provides an advantage of not having to move the arm once the ideal position is set.

In accordance with the method of the present invention, the drive shaft 72 has a receiving end, which can carry a drill bit or an anchoring member 34, and is positioned at the preselected angle to the seawall 10, and the drive shaft 72 is rotatably driven while being advanced or moved forwardly (or backwardly) in a longitudinal or axial direction to form a passage 76 extending entirely through the thickness of seawall 10 from the water facing side 24 to the earth facing side 26 as shown in FIG. 1. The passage 76 has a cross-sectional size to accommodate the anchoring member 34 extending therethrough and, accordingly, a drill bit 74 of appropriate size is selected for formation of the passage 76. The drive shaft 72 is retracted or moved rearwardly in the longitudinal or axial direction for withdrawal from the seawall 10 upon completion of the passage 76. Operation of the machinery 70 to control rotation and axial or longitudinal advancement and retraction of the drive shaft 72 may be affected by an operator situated on the machinery 70. A central longitudinal axis of the passage 76 is disposed at angle A with the water facing side 24 of the seawall 10 and extends downwardly from the water facing side 24 to the earth facing side 26. The angle A, the cross-sectional size of the passage 76 and the type and size of anchoring member 34 are predetermined or preselected in accordance with site-specific conditions, engineering tests and/or calculations.

Figure 3:
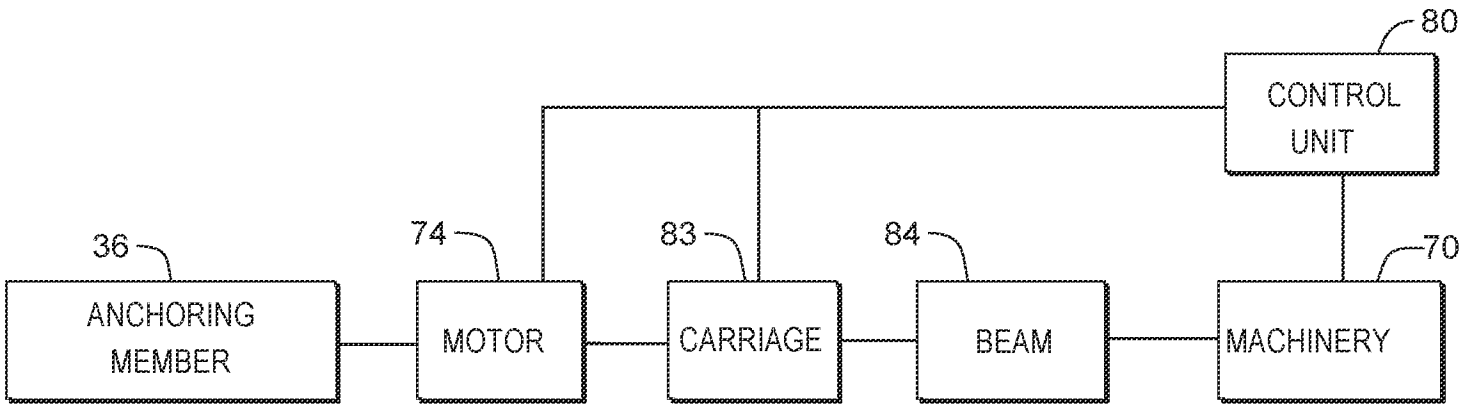
FIG. 3 depicts a block diagram of a tieback installation device, in accordance with another embodiment of the present invention.

In other embodiments, as shown in the block diagram in FIG. 3, a beam 84 is attached to the machinery 70 and a carriage 83 is attached to the beam 84. In some embodiments, a mount 70 is used to connect the beam 85 to the machine 70. The bean is, in some embodiments, a long member which the carriage 83 is able to ride or move along. The carriage 83 is attached to the beam 84 and is able to move along the beam 84. Attached to the carriage 83 is the motor assembly 73 (and the drive shaft 72). The carriage 83 provides for the longitudinal movement along the central axis of the motor assembly 73 and the anchoring member 36, so that the anchoring member 36 is installed substantially straight and with as little bending as possible.

In embodiments, where the motor assembly 74 has a drive shaft 72, the drive shaft 72 extends from an end towards the forward end of the beam 84. The drive shaft 72 is spaced over and above the beam 84 with the central longitudinal axis of the motor assembly 73 parallel to the central longitudinal axis of the beam 84. The central longitudinal axis of the motor drive shaft is contained in the plane centrally bisecting the beam 84. The central longitudinal axis of the drive shaft 72 defines or is coaxial with an installation axis along which the drive shaft moves longitudinally when the carriage 83 is moved longitudinally along the beam 84. The motor assembly 73 can be powered or driven by any suitable power source to rotate the drive shaft 72. In some embodiments, motor is powered hydraulically using hydraulic power supplied from a portable hydraulic transmission rig as needed to supply hydraulic power to the motor assembly 73 to rotate the drive shaft and move the carriage 83 along the beam 84. In other embodiments, the power source is the machinery 70. The drive shaft 72 has an attachment means which is compatible with the anchoring member 34 (e.g., tieback), or an extension which is coupled to the anchoring member 34. In one embodiment, the drive shaft has a socket style coupling means to engage with the anchoring member 34. In these embodiments, the carriage 83 moves along the beam 84 to drive the anchoring member 34 or the bore into the earth 14. The carriage 83 may have an independent power source from the motor assembly 73 but may also be controlled from the same power source as the motor assembly 73. The motor assembly 73 and the carriage 83 may be independently operated or may operate in conjunction with one another. In some embodiments, attached to the end of the beam 84 is a guide system. The guide system is coupled to the beam 84 and is removable to allow for the attachment of various guide systems based on the environmental requirements of the installation, the seal wall design, and the like. The guide system serves two purposes, one to assist in keeping the beam 84 secured in position relative to the seawall by engaging with the seawall to provide structural stability to the system. Second to assist in guiding the anchoring member 34 during installation and to keep the anchoring member 34 parallel with the beam 84 during the installation process. In some embodiments, the beam has a base attached to the far end, and the base is used to position the beam against the wall 10.

In some embodiments, the device may have a controller or control unit 80 which is either wired or wireless connected to the motor assembly 73 or the carriage 83 depending on the design of the tieback installation system. In the embodiment where a hydraulic drive is integrated into the motor assembly 73, the controls are provided in a wired setup which may be integrated into the piece of machinery 70 or in close proximity to the motor assembly 73. The motor assembly 73 may have an integrated computer system which provides for the monitoring of the motor assembly 73, the monitoring of the carriage 83, the monitoring of the anchoring member 34 position and provide data to a user. With the integrated computer system, a wireless drive may be integrated to provide for wireless control of the motor assembly 73 or the carriage 83. The integrated computer system is able to collect data related to various properties and readings related to the installation process of the anchoring member 34. For example, the computing system may be able to collect data related to the angle of installation of the anchoring member 34. In many applications a preferred angle of installation is 15 degrees to 20 degrees. The computing system may be able to assist the workers with maintaining this angle, and speed of installation to further assist in increasing the efficiency of the installation. Various warnings may be integrated into the computing system which can be provided to the user/worker if preset values are not met or adhered to. In some embodiments, the stabilizers are electronically controlled.

Once the passage 76 has been formed in seawall 10, the drive shaft 72 is coupled or connected with the shaft 38 of anchoring member 34 in coaxial relation or alignment. Coupling or connection of the drive shaft 72 with the shaft 38 may be performed above the water on or from the machinery 70. The drive shaft 72 having the anchoring member 34 coupled or connected thereto is positioned at an angle to seawall 10, and the drive shaft 72 is again advanced in a longitudinal or axial direction to introduce the anchoring member 34, forward end 40 first, into and through the passage 76 from the water facing side 24 to the earth facing side 26 of the seawall 10. The drive shaft 72 is rotated while continuing to be advanced in the longitudinal or axial direction to rotate and advance the anchoring member 34 into the retained earth 14 while the rearward end of the shaft 38 extends from the passage 76 along the water facing side 24 of the seawall 10. The configuration of forward end 40 and anchor 34 of anchoring member 34 facilitate advancement of the anchoring member in earth 14. As it is advanced, the anchoring member 34 contacts the retained earth 14 such that the anchoring member penetrates the retained earth. Accordingly, the portion of the anchoring member 34 extending into the retained earth from the earth facing side of the seawall is embedded in the retained earth 14 without any gap or space between the anchoring member and the surrounding earth. The anchoring member 34 is advanced a preselected or predetermined distance into earth 14 such that anchor 34 is anchored and embedded in earth 14 at a preselected or predetermined distance from the earth facing side 26 of seawall 10. The configuration of anchor 34 embedded in earth 14 resists withdrawal of the anchoring member 34 from the earth 14. The shaft 38 of anchoring member 34 extends through the passage 76, and the eternally threaded rearward end of shaft 38 extends from the passage on the water facing side 24 of seawall 10. As shown in FIG. 1, the rearward end of shaft 38 may extend from the passage 76 into the body of water 12.

Where the seawall 10 is made of a material capable of being cut or penetrated by anchor 34 being driven through passage 76, the cross-sectional size of passage 76 may be made no larger than necessary to accommodate the cross-section of shaft 38 extending therethrough. However, the cross-sectional size of passage 76 may be made larger than necessary to accommodate the cross-section of shaft 38 and may be made large enough to accommodate the cross-section of anchor 34. As described below, anchors may be used which have collapsed positions presenting a relatively small or narrow cross-section and expanded positions presenting a relatively large or wide cross-section as described below, and the passage 76 may be made no larger than necessary to accommodate the cross-section of the anchor in the collapsed position. Where an annular or other gap is presented in passage 76 around shaft 38 due to the cross-sectional size of the passage being larger than the cross-section of the shaft 38 extending therethrough, this gap can be filled with any suitable filler as explained further below.

The retaining member 36 is secured on the rearward end of shaft 38 along the water facing side 24 of seawall 10 with a predetermined torque to obtain a predetermined tension in anchoring member 34 and a predetermined compression against seawall 10 in an anchored position for the anchoring member. The rearward end of shaft 38 is inserted in the passage 76 of retaining member 36 with the abutment surface of the retaining member facing the water facing side 24 of seawall 10. Where the retaining member 36 is provided with retaining member 36, the retaining member 36 is rotated relative to the shaft 38 in a first rotational direction with the thread 50 on the rearward end in threaded engagement with the thread of passage 76. Rotation of the retaining member 36 relative to the shaft 38 in the first rotational direction causes forward advancement of the retaining member 36 longitudinally along the shaft 38 toward seawall 10. The retaining member 36 is rotated relative to the shaft 38 in the first rotational direction to a predetermined torque with the abutment surface in abutment with the water facing side 24 of seawall 10 to obtain a predetermined tension in anchoring member 34 and a predetermined compression against seawall 10. The retaining member 36 is secured on the shaft 38 in the longitudinal position corresponding to the predetermined torque, compression and tension due to engagement of thread 50 with the retaining member 36.

Where the anchoring member 34 comprises retaining member 36, the rearward end of shaft 38 is inserted in the passage 76, which may be provided without the internal thread, with the abutment surface facing the water facing side 24. The retaining member 36 is advanced along the shaft 38 in the direction of the seawall, and the end of shaft 38 extending rearwardly from the passage 76 is inserted in the hole of retaining member 36 to threadedly engage the internal thread of the retaining member 36 with the external thread 50 of shaft 38. The retaining member 36 is rotated in a first rotational direction to advance the retaining member 36 forwardly along shaft 38 into compressive engagement with the retaining member 36. The retaining member 36 is rotated to a predetermined torque with the abutment surface of the retaining member 36 applying a predetermined compression against seawall 10. The retaining member 36 and the retaining member 36 are secured on shaft 38 in longitudinal positions corresponding to the predetermined torque, compression and tension, the retaining member 36 being held in place due to engagement of its thread with the thread of shaft 38.

When the anchoring member 34 is installed on seawall 10, the seawall 10 and earth 14 between the retaining member 36 and anchor 34 are compressed, and the anchoring member 34 is tensioned between retaining member 36 and anchor 34 to strengthen seawall 10 to resist displacement of the seawall in the direction of water 12. The predetermined torque, compression and tension are selected in accordance with site-specific conditions, the type and/or size of anchoring member, and engineering specifications. Since the central longitudinal axis of passage 76 and shaft 38 are disposed at angle A to the abutment surface, the abutment surface is in face-to-face abutment or contact with the water facing side 24 of seawall 10 along plane P, with the central longitudinal axis of shaft 38 extending downwardly from the water facing side 24 to the earth facing side 26.

The retaining member 36 can be secured on the rearward end of shaft 38 at various positions along the length of rearward end. Where the retaining member 36 is provided with retaining member 36, the torque, compression and tension can be increased by further rotating the retaining member 36 relative to the shaft 38 in the first rotational direction, and the torque, compression and tension can be decreased by rotating the retaining member 36 relative to shaft 38 in a second rotational direction, opposite the first rotational direction, to cause retraction or rearward movement of the retaining member 36 longitudinally along the shaft 38 in a direction away from seawall 10. When the retaining member 36 is used to secure the retaining member 36, the torque, compression and tension can be increased by further rotating the retaining member 36 in the first rotational direction, and the torque, compression and tension can be decreased by rotating the retaining member 36 in a second rotational direction, opposite the first rotational direction, to cause retraction or rearward movement of the retaining member 36 longitudinally along the shaft 38 in the direction away from seawall 10. Accordingly, torque, compression and tension adjustments are possible in the anchoring devices. The retaining member 36 and retaining member 36 could be rotated, advanced and retracted via drive shaft 72 using an appropriate connector or coupling to releasably couple or connect the retaining member 36 and/or retaining member 36 to the drive shaft 72. The retaining member 36 and retaining member 36 can be secured on the anchoring member 34 using any other suitable machinery or tools operated and controlled from the machinery 70.

FIG. 1 depicts anchoring member 34 as a first anchoring device installed on seawall 10 at a first location and depicts drive shaft 72 in the process of drilling another passage 76 through seawall 10 for installation of another or second anchoring device to be installed on seawall 10 at a second location spaced laterally above the first anchoring member 34. In FIG. 1, a portion of rearward end protrudes from the retaining member 36 on the water facing side 24 of seawall 10. If desired, this portion can be cut or trimmed following installation of anchoring member 34. However, it may be advantageous to allow this portion to remain intact to facilitate torque, compression and/or tension adjustments of anchoring member 34 conducted following installation. Following installation, the anchoring member 34 can be periodically checked or inspected, and the torque, compression and/or tension can be increased or otherwise adjusted as needed to strengthen seawall 10.

Where seawall 10 is not already damaged or unstable, one or more anchoring members 34 may be installed on seawall 10 to strengthen the seawall to resist potential damage or instability. The compressive force applied by the one or more anchoring members 34 against seawall 10 via the intermediary of earth 14 enables the seawall 10 to resist deviation from original design specifications, such as displacement from its upright vertical orientation. Where seawall 10 has already deviated from its original design specifications and experienced actual damage or instability, such as displacement from its upright vertical orientation, the one or more anchoring members 34 can be used to strengthen the seawall and repair the actual deviation or damage. Depending on the amount of displacement of seawall 10 from its original design specifications, sufficient compressive force may be applied against the seawall 10 by the installation of one or more anchoring devices to repair the seawall by moving it to the upright vertical orientation and to strengthen the seawall by resisting displacement from the upright vertical orientation. Accordingly, a seawall that has deviated from its original design specifications may be restored to its original design specifications upon the installation of one or more anchoring devices. More commonly, incremental adjustments made to the one or more anchoring devices over time will be needed to restore a deviated seawall to its original design specifications. One or more anchoring members 34 can be installed on seawall 10 to repair various types or stages of damage in seawall 10. Where a plurality of anchoring members 34 are installed on seawall 10, the angle A for the anchoring devices may be the same as or different from each other. Paint, epoxy and/or urethane may be applied to exposed surfaces following installation of one or more anchoring devices for added strength, protection and/or cosmetic enhancement.

Each anchoring member is inserted in a passage formed through the seawall and is advanced in the passage into the retained earth to anchor the anchor in the retained earth a distance spaced from an earth facing side of the seawall. The end of each anchoring member extends from the passage along the water facing side of the seawall, and the retaining member is secured on the end of the anchoring member extending from the passage. The retaining members apply compressive force against the seawall by virtue of the seawall and retained earth being compressed between the retaining members and the anchors and by virtue of the anchoring members being tensioned between the retaining members and the anchors. The connecting member rigidly interconnects the ends of the anchoring members to fix or maintain the separation distance between the anchoring members, and the connecting members may be attached to the retaining members of the anchoring devices. The length of the connecting member between the interconnected anchoring members or devices may be fixed or may be adjustable to permit the separation distance between the anchoring members or devices to be selectively adjusted.

Depending on the size of the opening in the seawall, the opening may be completely closed with one adjustment of interconnected anchoring members. More commonly, an opening will be closed incrementally over time with periodic adjustments of interconnected anchoring members With the methods of the present invention, compressive force may be applied against a seawall by one or more anchoring devices sufficient to prevent displacement of the seawall without the need for cementitious material to assist in anchoring. The methods of the present invention can be conducted entirely from a vessel located on the body of water without the need for excavation or disturbance of the earth, earth-side access to the seawall or underwater diving. The methods can be used to strengthen various types of seawalls to resist potential damage and to correct various types and stages of actual damage. The anchors can have various configurations to anchor the anchoring members in the retained earth, and the retaining members can have various configurations. The retaining members can be secured on the anchoring members in various ways including the use of securing members threaded onto the ends of the anchoring members. Where a gap is presented around the anchoring member in the passage through the seawall, various types of fillers can be used to fill the gap. The fillers can include structural components or filler materials not having a definitive structural shape. The retaining members may comprise flanges having various planar or non-planar configurations, and the abutment surfaces of the retaining members can have various configurations. The anchoring devices may include various inserts insertable between the retaining members and the water facing side of the seawall. The retaining members distribute force or pressure against the seawall to resist displacement thereof. Any number of anchoring devices can be installed in a seawall at various locations and in various arrangements. Any pair of anchoring devices can be rigidly interconnected to maintain a fixed separation distance between the anchoring devices. Any pair of anchoring devices may be interconnected using a connecting member which permits adjustment of the separation distance between the interconnected anchoring devices. Adjustable connecting members may be provided which permit the separation distance between interconnected anchoring devices to be increased and/or decreased. Anchoring devices can be installed on relatively movable portions of a seawall and adjustably interconnected to effect movement of the relatively movable portions and thereafter maintain the adjusted position of the relatively movable portions. Adjustably interconnected anchoring devices can be used to close various types of openings in seawalls including openings between seawall panel portions and between seawall panels. Adjustably interconnected anchoring devices can also be used to separate relatively movable portions of a seawall including relatively movable panels or panel portions. The type of anchoring device or devices utilized and the torque, compression and tension for the anchoring device or devices may be selected in accordance with site-specific conditions and engineering specifications. Following initial installation, the anchoring devices and apparatus of the present invention can be checked or inspected periodically, and adjustments may be made as needed to maintain or obtain a desired torque, compression and/or tension. Deviations from original design specifications can be corrected in seawalls using the anchoring devices to apply the necessary corrective forces. A deviation from original design specifications can be corrected at one time in a single application of corrective force or forces using one or more devices or may be corrected dynamically or incrementally over a period of time in multiple applications of corrective force or forces using one or more anchoring devices, much in the manner of orthodontia.

Inasmuch as the present invention is subject to many variations, modifications and changes in detail, it is intended that all subject matter discussed above or shown in the accompanying drawings be interpreted as illustrative only and not be taken in a limiting sense.

Inasmuch as the present invention is subject to many variations, modifications and changes in detail, it is intended that all subject matter discussed above or shown in the accompanying images be interpreted as illustrative only and not be taken in a limiting sense.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A tieback installation system, comprising:

a mount secured to a piece of machinery having mechanical, hydraulic, and electrical connection means, and wherein the machinery is positioned distal to a wall;

a motor mechanically connected to the mount and hydraulically and electrically connected to the piece of machinery;

a control unit electronically connected to the motor; and a drive shaft connected to the motor, wherein the drive shaft is able to receive a drill bit or an anchoring member, wherein the anchoring member has a retaining member secured to an end which interfaces with the drive shaft, and wherein the anchoring member has a flange with that is sized greater than a passage through a seal wall;

wherein the mount allows for the adjustment of the position of the motor and the drive shaft.

2. The tieback installation system of claim 1, wherein the drive shaft is longitudinally extending from the motor.

3. The tieback installation system of claim 1, wherein the piece of machinery has hydraulic and electrical controls, and wherein the hydraulic and electrical controls are connected to the motor.

4. The tieback installation system of claim 1, wherein the motor provides a rotary motion about a longitudinal axis.

5. The tieback installation system of claim 1, wherein a controls of the piece of machinery are able to maintain the motor, drive shaft, and anchoring member along a longitudinal axis, while also translating the anchoring member along the longitudinal axis.

6. The tieback installation system of claim 1, wherein the hydraulic and electrical controls are remote.

7. The tieback installation system of claim 1, wherein the drive shaft is releasably connected to the anchoring member.

8. A tieback installation system comprising:

a guide system connected to a piece of machinery and positioned distal to a seal wall, and wherein the guide system is comprised of;

a beam, wherein the beam is mechanically connected to the piece of machinery; and a carriage, wherein the carriage is attached to the beam and the carriage is able to move along the beam;

a motor mechanically connected to the guide system and hydraulically and electrically connected to a control unit; and a drive shaft connected to the guide system, wherein the drive shaft is sized to receive an anchoring member and a retaining member, wherein the retaining member is sized to cover a passage which the anchoring member is inserted into, wherein the carriage and the motor are controlled independently of one another, wherein the piece of machinery moves as the anchoring member is installed.

9. The tieback installation system of claim 8, wherein the motor is connected to the carriage.

10. The tieback installation system of claim 8, wherein the motor and the carriage are electrically connected to the control unit.

11. The tieback installation system of claim 8, wherein the motor and the carriage are hydraulically connected to the control unit.

12. The tieback installation system of claim 8, wherein a central axis of the motor is substantially parallel with a longitudinal axis of the beam.

13. The tieback installation system of claim 9, wherein the beam further comprises a base, wherein the base is attached to an end of the beam which is in close proximity to a seal wall.

14. The tieback installation system of claim 8, the retaining member has a central passage and wherein the central passage is not centrally located on the retaining member.

15. The tieback installation system of claim 14, the retaining member central passage is threaded, and the anchoring member has a threaded portion that interfaces with the central passage of the retaining member to create a substantially water tight seal.

16. The tieback installation system of claim 8, wherein the passage has an internal thread and the anchoring member has a threaded portion which interfaces with the internal thread of the passage to create a substantially watertight seal.

17. The tieback installation system of claim 8, wherein an external surface of the retaining member is threaded and the passage has an internal threaded portion that interfaces with the external surface of the retaining member to create a substantially watertight seal.

18. The tieback installation system of claim 8, wherein the anchoring member is installed at an acute angle.

19. A method of installing a tieback, the method comprising installing a drill bit on to a drive shaft, which is connected to a mount that is attached to a machine;

positioning the drill bit at a predetermined location along a sea wall and at a predetermined angle distal to the sea wall, wherein there is no contact with the wall expect for the drill bit;

activating the motor to engage the drive shaft to drill an aperture through the seal wall and a predetermined distance into the earth along an axis, wherein only a drill bit comes in contact with the seal wall;

detaching the drill bit and attaching an anchoring member with a retaining member to be inserted into the aperture; and securing the anchoring member in the aperture with a retaining member and a flange.

* * * * *